US007164091B2

(12) United States Patent
Lu

(10) Patent No.: US 7,164,091 B2
(45) Date of Patent: Jan. 16, 2007

(54) CIRCUIT BOARD ASSOCIATED ELECTRICAL SWITCH

(75) Inventor: Chiu Ming Lu, Chung Ho (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/219,430

(22) Filed: Sep. 2, 2005

(65) Prior Publication Data

US 2006/0049028 A1 Mar. 9, 2006

(30) Foreign Application Priority Data

Sep. 3, 2004 (TW) ..... 93214077 U

(51) Int. Cl.
*H01H 9/00* (2006.01)

(52) U.S. Cl. ..... 200/292; 200/520; 439/74; 439/660

(58) Field of Classification Search ..... 200/292, 200/52 R, 520, 329, 341; 439/74, 67, 77, 439/55, 660, 931; 338/160–162, 118
See application file for complete search history.

(56) References Cited

U.S. PATENT DOCUMENTS 5,189,387 A * 2/1993 Childers et al. ..... 338/20
5,364,294 A * 11/1994 Hatch et al. ..... 439/676
5,821,465 A * 10/1998 Tanaka et al. ..... 174/88 R
5,896,557 A * 4/1999 Suzuki et al. ..... 725/139
5,912,613 A * 6/1999 Kotani et al. ..... 338/160

* cited by examiner

*Primary Examiner*—Richard K. Lee
(74) *Attorney, Agent, or Firm*—Charles S. Cohen

(57) ABSTRACT

An electrical switch assembly includes an electrical switch having a dielectric housing mounting at least a pair of switch terminals having contact arms exposed at one side of the housing. A printed circuit board has a major flat surface and a side edge surface which faces the one side of the housing. At least a pair of L-shaped conductive contact pads are mounted on the printed circuit board. The L-shaped contact pads have terminating leg portions on the major flat surface of the circuit board for electrical connection to appropriate circuit traces on the board. The contact pads have contact leg portions at the side edge surface of the circuit board for engaging the contact arms of the switch terminals.

17 Claims, 5 Drawing Sheets

CIRCUIT BOARD ASSOCIATED ELECTRICAL SWITCH

FIELD OF THE INVENTION

This invention generally relates to the art of electrical switches and, particularly, to an electrical switch assembly which is operatively associated with a printed circuit board.

BACKGROUND OF THE INVENTION

Electrical switches are used in association with printed circuit boards in a variety of applications. For instance, such switches are commonly used for volume adjustment of mobile telephones, adjustment of an LCD display or similar applications. These switch assemblies often have buttons which are moved toward and away from circuit traces on a printed circuit board to close and open switch circuits on the board.

A design problem in many such applications is that the adjustment controls, such as the buttons, are located at a side of various electronic appliances such as the mobile telephones which are very thin appliances. The printed circuit board is a flat structure which lies in the flat plane of the appliance. Therefore, the adjustment controls or buttons are operatively associated with the circuit board at a thin edge thereof.

In prior art applications as described above, flat flexible electrical cables are used to electrically couple the terminals of the electrical switch to the contacts or circuit traces on the printed circuit board. An auxiliary electrical connector often is mounted on the printed circuit board, with piercing-type terminals for electrical connection to the flexible cable. The switch terminals are electrically coupled through the flexible cable to the connector on the flat surface of the circuit board. Such prior art structural assemblies have various problems and/or disadvantages including an excessive number of components which increase the size of the assembly, when miniaturization is the trend in these electronic products. The cost of the assembly also is significantly increased. In addition, the switch terminals are indirectly connected through too many contacts which causes signal delay and which, in turn, results in inaccuracy and low reliability. The present invention is directed to solving this myriad of problems.

SUMMARY OF THE INVENTION

An object, therefore, of the invention is to provide a new and improved electrical switch assembly operatively associated with a printed circuit board.

In the exemplary embodiment of the invention, the electrical switch assembly includes an electrical switch having a dielectric housing mounting at least a pair of switch terminals having contact arms exposed at one side of the housing. A printed circuit board has a major flat surface and a side edge surface which faces the one side of the housing. At least a pair of L-shaped conductive contact pads are mounted on the printed circuit board. The L-shaped contact pads have terminating leg portions on the major flat surface of the circuit board for electrical connection to appropriate circuit traces on the board. The contact pads have contact leg portions at the side edge surface of the circuit board for engaging the contact arms of the switch terminals.

According to one aspect of the invention, the electrical switch includes three of the switch terminals having contact arms for engaging the contact leg portions of three of the L-shaped conductive contact pads on the printed circuit board. One of the terminals is a common terminal for switch association with either of the other two terminals. The switch includes a pair of conductive switch elements. Each switch element is movable into engagement with the common terminal and a selected one of the other two terminals to close a circuit therethrough and through the associated contact pads on the printed circuit board.

According to other aspects of the invention, the contact arms of the switch terminals comprise flexible contact arms biased into engagement with the contact leg portions of the L-shaped conductive pads on the printed circuit board. The dielectric housing of the electrical switch may be insert molded about body portions of the switch terminals. The conductive contact pads may be disposed in grooves in the printed circuit board whereby the surfaces of the pads are generally flush with surrounding surfaces of the circuit board.

According to one embodiment of the invention, the contact leg portions of the L-shaped conductive pads rigidly abut against the side edge surface of the printed circuit board. In another embodiment of the invention, the contact leg portions are resiliently spaced from the side edge surface of the printed circuit board. In a further embodiment of the invention, the contact leg portions have projecting dimples to provide positive engagement with the contact arms of the switch terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
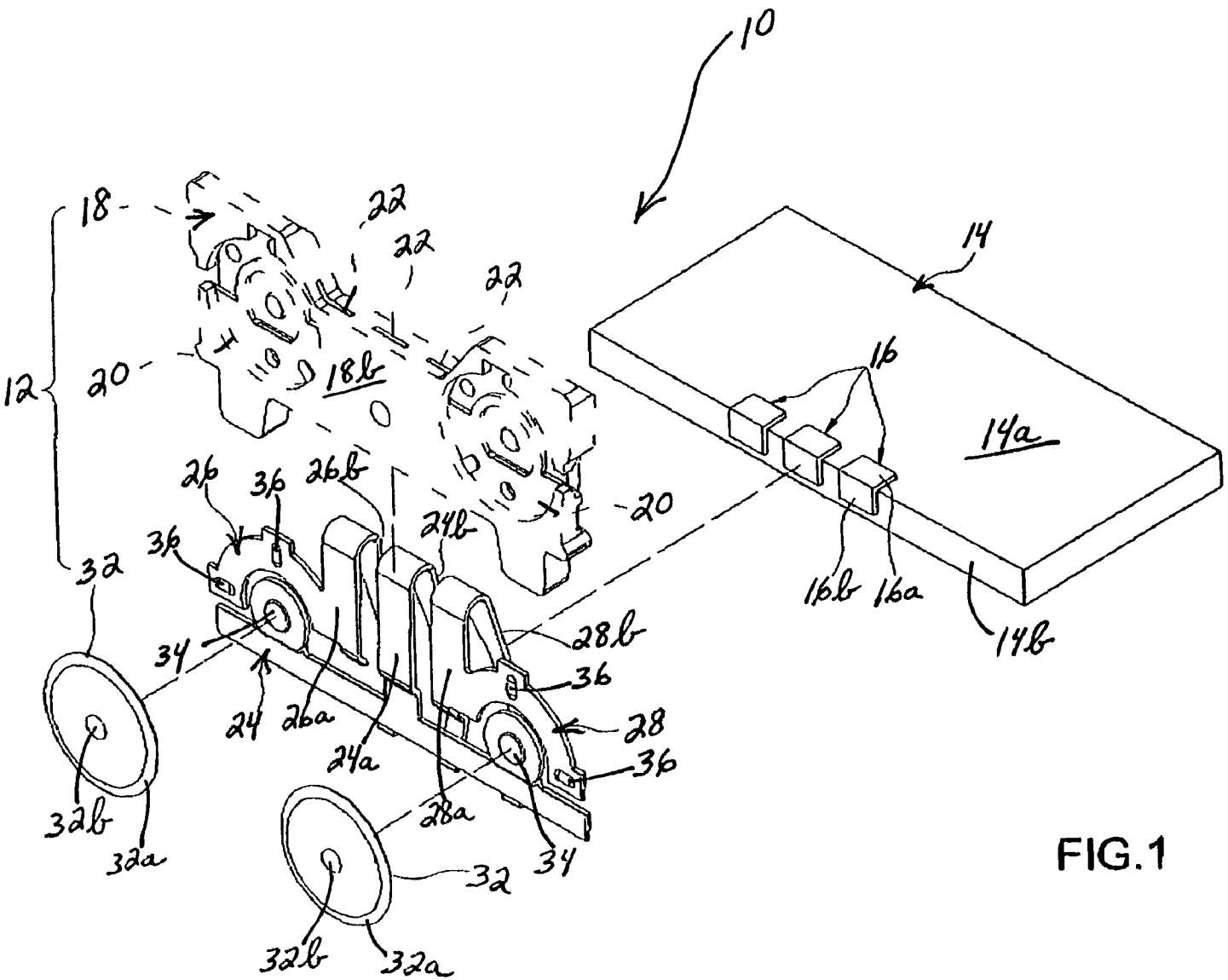
FIG. 1 is an exploded perspective view of an electrical switch assembly according to the invention, with the housing of the electrical switch shown in phantom.
Figure 2:
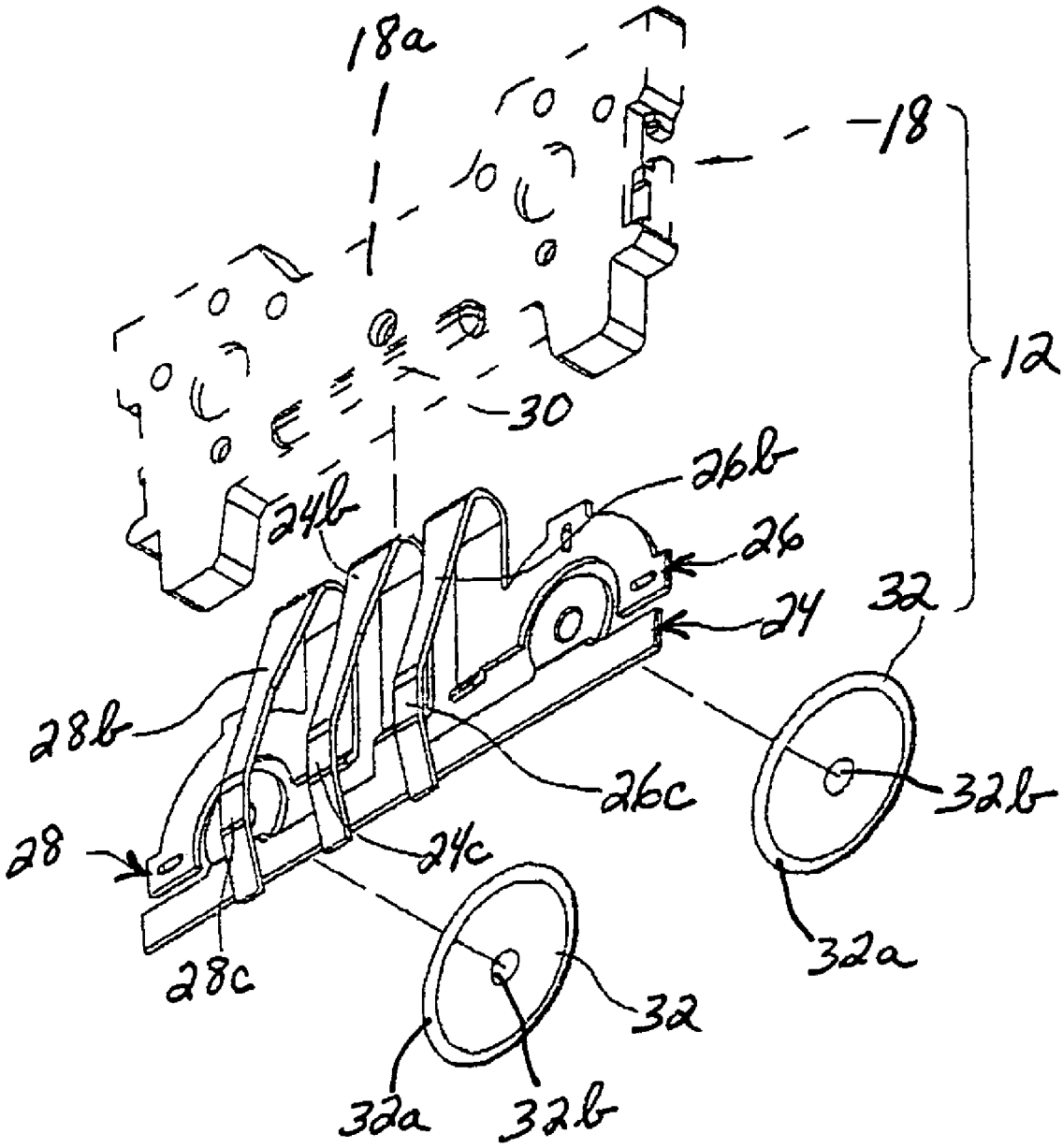
FIG. 2 is an exploded perspective view of the electrical switch, looking at the back side of the switch as depicted in FIG. 1, and with the housing again shown in phantom.
Figure 3:
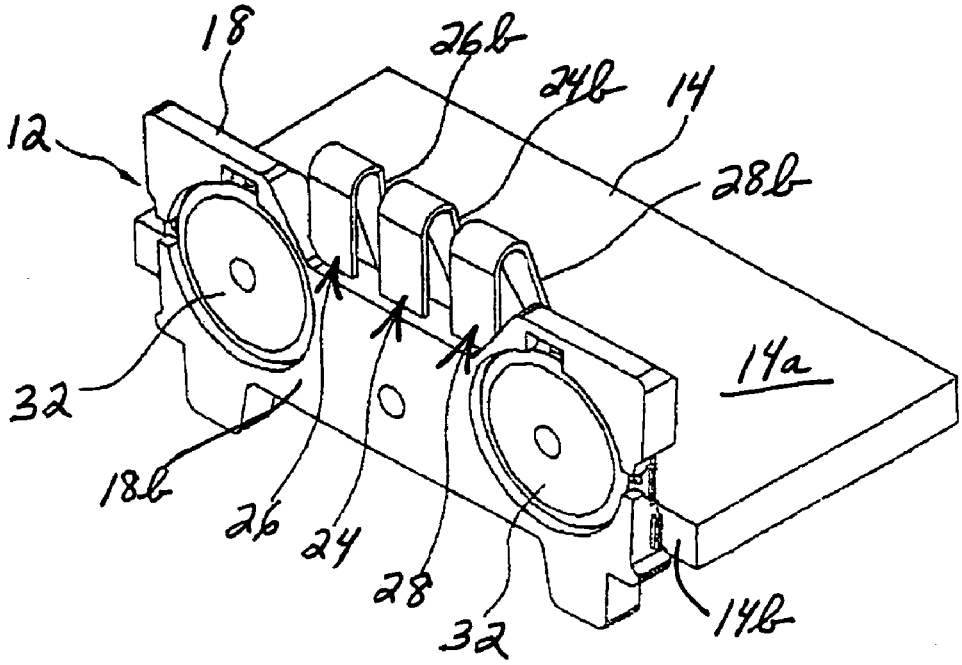
FIG. 3 is a perspective view of the electrical switch assembly in assembled condition.

Referring to the drawings in greater detail, and first to FIGS. 1–4, the invention is embodied in an electrical switch assembly, generally designated 10, which includes an electrical switch 12 mounted on or adjacent to a printed circuit board, generally designated 14. Such an electrical switch assembly might be used in mobile telephones, LCD displays or like electronic appliances. The electronic appliance will include a housing, framework or other structure which will mount the housing of switch 12 in rigid position immediately adjacent the printed circuit board.

Printed circuit board 14 includes a major flat surface 14*a* and a side edge surface 14*b* which faces switch 12. A plurality of L-shaped conductive contact pads, generally designated 16, are mounted on the circuit board. Three contact pads 16 are used in switch assembly 10. Each of the L-shaped contact pads 16 has a terminating leg portion 16*a* and a right-angled contact leg portion 16*b*. The terminating leg portions of contact pads 16 are disposed on the major flat surface 14*a* of the printed circuit board for electrical connection to appropriate circuit traces (not shown) on the board. The contact leg portions of contact pads 16 are disposed on the side edge surface 14*b* of the circuit board for engaging contact arms of switch terminals of electrical switch 12 as described below.

Electrical switch 12 of switch assembly 10 includes an insulative or dielectric housing, generally designate 18, which is a one-piece structure unitarily molded of plastic material or the like. The housing is somewhat flat and includes one side 18*a* (FIGS. 2 and 4) which faces printed circuit board 14, and a second side (FIGS. 1 and 3) which faces away from the circuit board. A pair of circular recesses 20 are formed in side 18*b* of the housing. A plurality of terminal-receiving passages 22 are formed vertically through the housing as viewed in FIG. 1.

Figure 4:
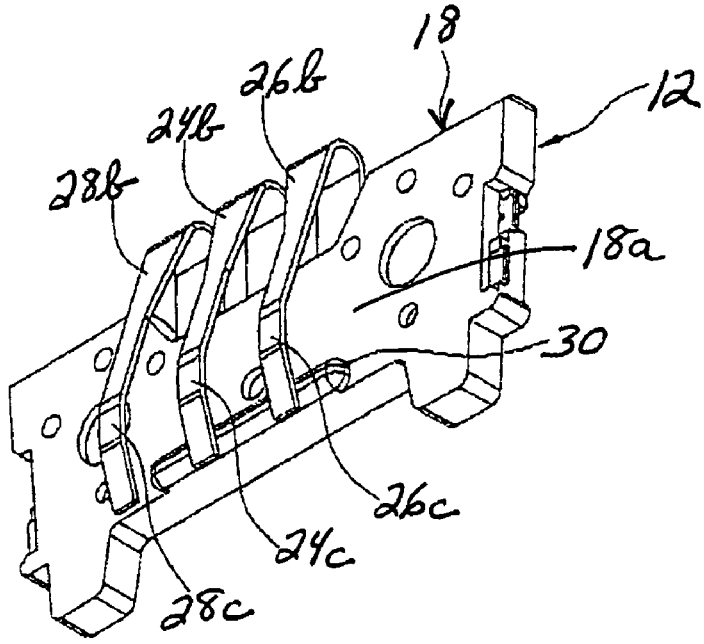
FIG. 4 is a view similar to that of FIG. 2, but with the electrical switch in assembled condition.

Electrical switch 12 also includes three terminals, generally designated 24, 26 and 28. The terminals may be stamped and formed of conductive sheet metal material and include body portions 24*a*, 26*a* and 28*a*, along with flexible contact arms 24*b*, 26*b* and 28*b* which are bent back over and spaced from body portions 24*a*, 26*a* and 28*a*, respectively. The flexible contact arms, in turn, have contact portions 24*c*, 26*c* and 28*c* for engaging contact leg portions 16*b* of contact pads 16 on printed circuit board 14. FIG. 4 shows that housing 18 is molded with an elongated, projecting rib 30 which runs behind contact arms 24*b*–28*b* of the switch terminals. The rib prevents over-stressing of the flexible contact arms.

Electrical switch 12 of switch assembly 10 includes two disk-like switch buttons 32 which are adhered within recesses 20 in side 18*b* of housing 18. The switch buttons are fabricated of conductive material, such as spring metal material. Each switch button is somewhat dome-shaped to present a concave side facing the housing within the respective recess 20. As best seen in FIG. 1, peripheral edges 32*a* of the switch buttons can be adhered to the housing within recesses 20. With the switch buttons being dome-shaped, center portions 32*b* of the buttons, therefore, are spaced away from the housing and spaced away from contact bosses of terminal 24 as described below.

FIG. 1 best shows that terminal 24 is a center or common terminal in that its flexible contact arm 24*b* is disposed between contact arms 26*b* and 28*b* of end terminals 26 and 28. The center or common switch terminal is provided with a pair of contact bosses 34 at opposite ends of body portion 24*a* which is elongated and extends substantially the entire width of the switch. The body portions of each of the end terminals 26 and 28 are provided with a pair of contact bosses 36. Contact bosses 34 and 36 project away from the respective body portions toward switch buttons 32. When the conductive switch buttons 32 are adhered within recesses 20, the peripheral edges 32*a* of the switch buttons are maintained in contact with the projecting contact bosses 36 of the respective end terminals 26 and 28. The center portions 32*b* of the conductive switch buttons are maintained in a spaced relationship away from projecting contact bosses 34 of the common switch terminal 24.

In assembly of electrical switch 12, switch terminals 24–29 may be assembled within appropriately configured passages within housing 18, with contact arms 24*b*–28*b* in a straight condition and inserted through the terminal-receiving passages 22 and subsequently bent into the shapes shown in the drawings. On the other hand, and preferably, dielectric housing 18, being molded of plastic material, is inserted molded about portions of the terminals. After the insert-molding process, the projecting contact bosses 34 of common terminal 24 and the projecting contact bosses 36 of end terminals 26 and 28 are left exposed within recesses 20 of the housing for engagement by the conductive switch buttons 32. Obviously, flexible contact arms 24*b*–28*b* are left exposed outside the molded housing as is shown in the drawings.

Figure 5:
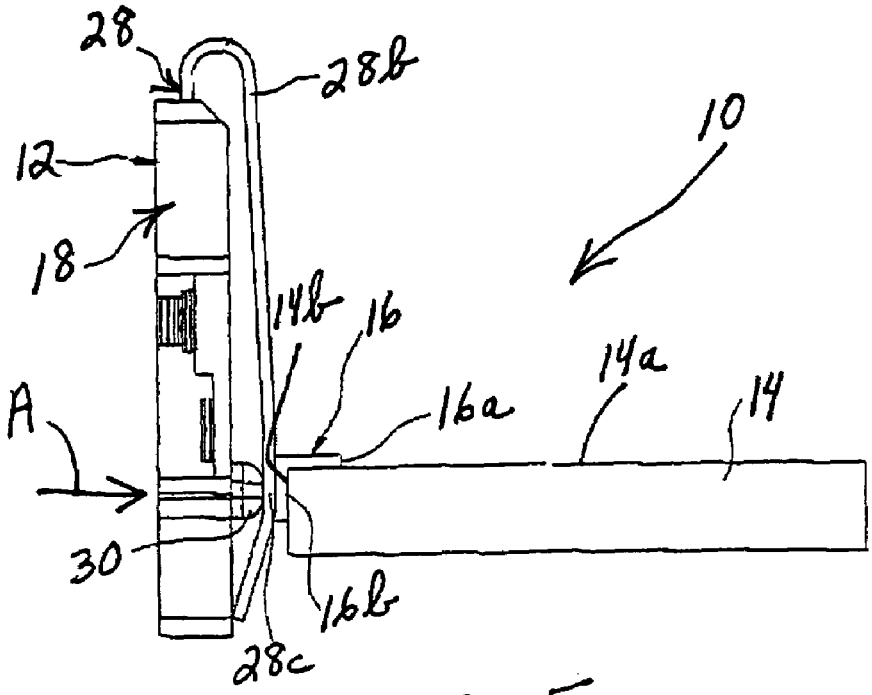
FIG. 5 is a side elevational view of the switch assembly, showing one embodiment of the contact pads on the printed circuit board.

After switch assembly 10 is assembled as described above, the switch assembly is mounted within the appropriate housing or framework of the electronic appliance, with contact portions 24*c*–28*c* on flexible contact arms 24*b*–28*b* of switch terminals 24–28 in engagement with the contact leg portions 16*b* of contact pads 16 as can be seen in FIG. 5. When it is desired to close a circuit between common switch terminal 24 and end switch terminal 26, and their corresponding contact pads 16 on printed circuit board 14, the left-hand switch button 32 (as viewed in FIG. 1) is pushed inwardly in the direction of arrow "A" (FIG. 5). This closes a circuit between switch terminals 24 and 26 and the two left-hand contact pads 16 as viewed in FIG. 1. With the switch button being dome-shaped and of flexible spring metal material, the switch button will return to its "open" position upon release of pressure on the button. Similarly, pushing in on the right-hand switch button 32 as viewed in FIG. 1, will close a circuit between terminals 24 and 28 and the right-hand two contact pads 16 as viewed in FIG. 1.

Figure 6:
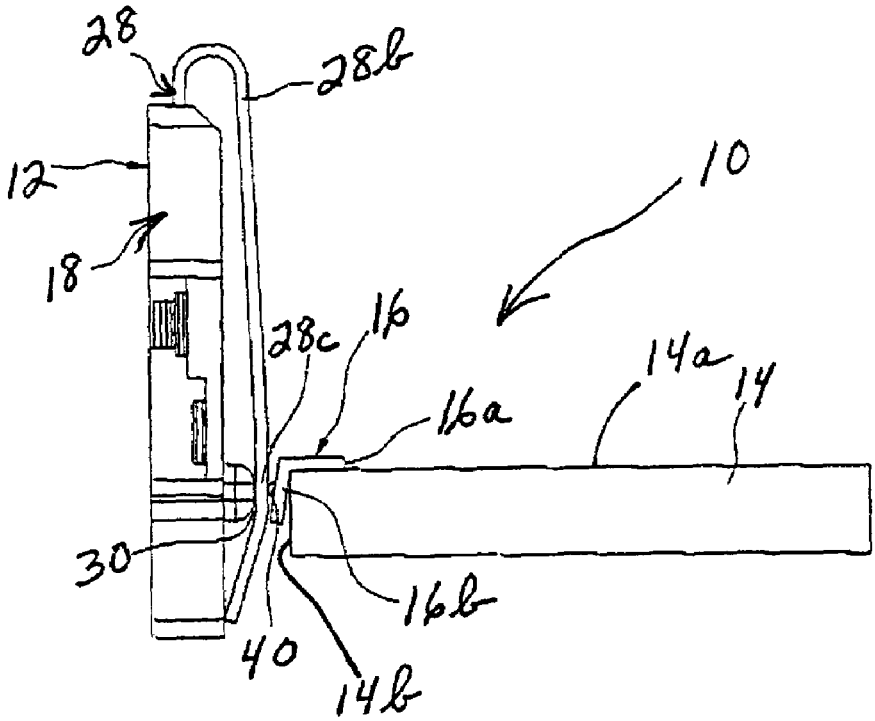
FIG. 6 is a view similar to that of FIG. 5, showing a second embodiment of the contact pads on the circuit board.

FIG. 5 shows an embodiment of the invention wherein the contact leg portions 16*a* and 16*b* of the L-shaped conductive contact pads 16 rigidly abut against the major flat surface 14*a* and the side edge surface 14*b* of printed circuit board 14. On the other hand, FIG. 6 shows a second embodiment wherein the terminating leg portions 16*a* of the contact pads rigidly abut against the major flat surface 14*a* of the circuit board, but the contact leg portions 16*b* of the contact pads are angled so as to be spaced from the side edge surface 14*b* of the circuit board. The spaced leg portions 16*b* create some flexibility in the contact leg portions and increases the contact pressure between the switch terminals and the contact pads on the printed circuit board.

FIG. 6 also shows an embodiment wherein a dimple 40 projects from each contact leg portion 16*b* of each contact pad toward and into engagement with the contact portion (28*c*) of the respective switch terminal. This creates a more positive engagement between the contact pads and switch terminals.

Figure 7:
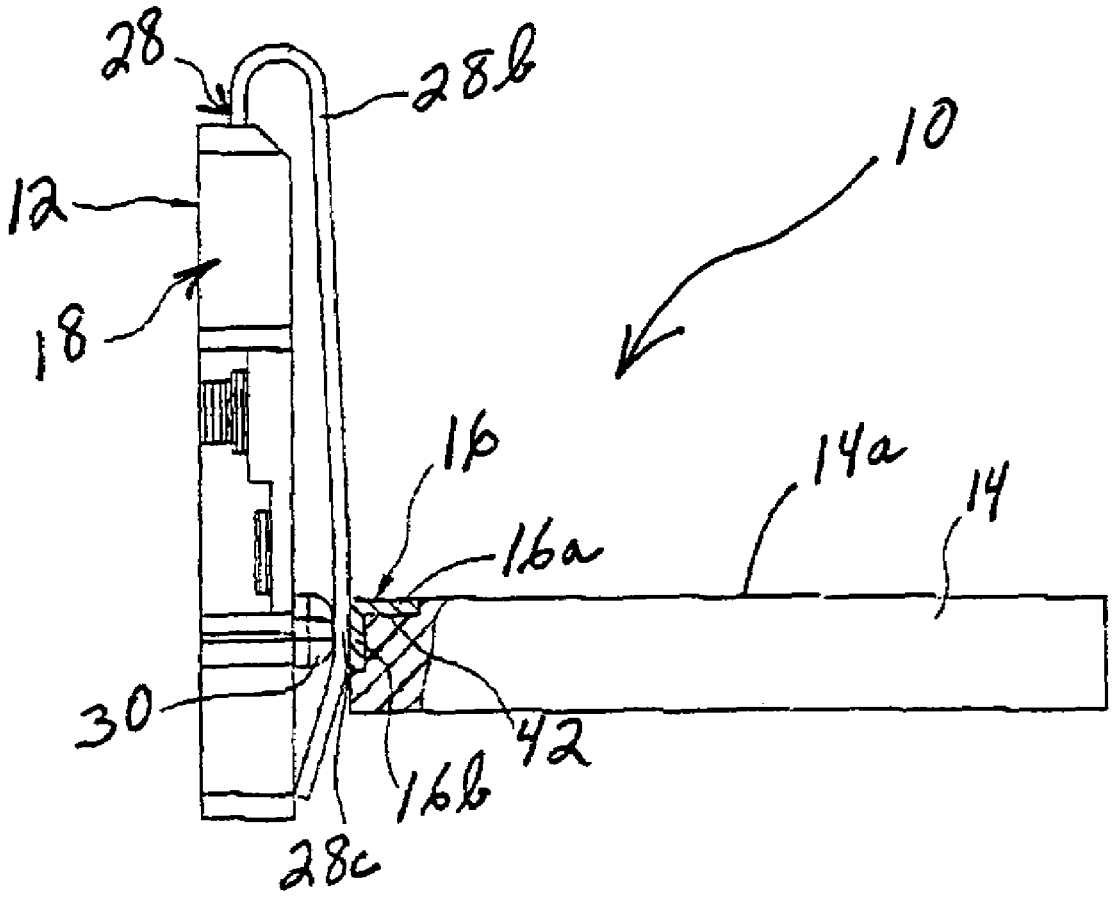
FIG. 7 is a view similar to that of FIGS. 5 and 6, showing a third embodiment of the contact pads on the circuit board.

Finally, FIG. 7 shows an embodiment wherein contact pads 16 are disposed in grooves 42 formed in the printed circuit board at the upper corner of the major flat surface and the side edge surface of the board. The grooves are formed at depths so that the exposed surfaces of the contact pads are generally flush with the surrounding surfaces of the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical switch assembly, comprising:

an electrical switch including a dielectric housing mounting at least a pair of switch terminals having contact arms exposed at one side of the housing; and a printed circuit board having a major flat surface and a side edge surface facing said one side of the housing, and at least a pair of L-shaped conductive contact pads mounted on the printed circuit board and including terminating leg portions on the major flat surface for electrical connection to appropriate circuit traces on the board and contact leg portions at the side edge surface of the circuit board for engaging the contact arms of the switch terminals.

2. The electrical switch assembly of claim 1 wherein said electrical switch includes a conductive switch element for movement into engagement with the switch terminals to close a circuit therethrough and through the conductive contact pads on the printed circuit board.

3. The electrical switch assembly of claim 1 wherein the contact arms of said switch terminals comprise flexible contact arms biased into engagement with the contact leg portions of the L-shaped conductive contact pads on the printed circuit board.

4. The electrical switch assembly of claim 1 wherein the dielectric housing of said electrical switch is insert molded about portions of the switch terminals.

5. The electrical switch assembly of claim 1 wherein said electrical switch includes three of said switch terminals having contact arms for engaging the contact leg portions of three of said conductive contact pads on the printed circuit board, with one of the terminals being a common terminal for switch association with either of the other two terminals.

6. The electrical switch assembly of claim 5 wherein said electrical switch includes a pair of conductive switch elements, each switch element being movable into engagement with the common terminal and a selected one of the other two terminals to close a circuit therethrough and through the associated contact pads on the circuit board.

7. The electrical switch assembly of claim 1 wherein the contact leg portions of said L-shaped conductive pads rigidly abut against the side edge surface of the printed circuit board.

8. The electrical switch assembly of claim 1 wherein the contact leg portions of said L-shaped conductive pads are resiliently spaced from the side edge surface of the printed circuit board.

9. The electrical switch assembly of claim 1 wherein the contact leg portions of said L-shaped conductive pads have projecting dimples for positively engaging the contact arms of the switch terminals.

10. The electrical switch assembly of claim 1 wherein said conductive contact pads are disposed in grooves in the printed circuit board.

11. An electrical switch assembly, comprising:

an electrical switch including a dielectric housing mounting at least three switch terminals having flexible contact arms exposed at one side of the housing, with one of the switch terminals being a common center terminal for switch association with either of the other two terminals, and a pair of conductive switch elements with each switch element being movable into engagement with the common switch terminal and a selected one of the other two switch terminals to close a circuit therethrough; and a printed circuit board having a major flat surface and a side edge surface facing the one side of the housing, at least three L-shaped conductive contact pads mounted on the printed circuit board and including terminating leg portions on the major flat surface for electrical connection to appropriate circuit traces on the board and contact leg portions at the side edge surface of the circuit board for engaging the flexible contact arms of the switch terminals.

12. The electrical switch assembly of claim 11 wherein the dielectric housing of said electrical switch is insert molded about portions of the switch terminals.

13. The electrical switch assembly of claim 11 wherein the contact leg portions of said L-shaped conductive pads rigidly abut against the side edge surface of the printed circuit board.

14. The electrical switch assembly of claim 11 wherein the contact leg portions of said L-shaped conductive pads are resiliently spaced from the side edge surface of the printed circuit board.

15. The electrical switch assembly of claim 11 wherein the contact leg portions of said L-shaped conductive pads have projecting dimples for positively engaging the contact arms of the switch terminals.

16. The electrical switch assembly of claim 11 wherein said conductive contact pads are disposed in grooves in the printed circuit board.

17. The electrical switch assembly of claim 11 wherein said three switch terminals include two end terminals with said common terminal therebetween, and the contact leg portion of a center one of the contact pads on the printed circuit board is associated with the common switch terminal.

* * * * *